US006052088A

United States Patent [19]

Simmons et al.

[11] Patent Number: 6,052,088

[45] Date of Patent: Apr. 18, 2000

[54] MULTI-BAND ANTENNA

[75] Inventors: Kenneth D. Simmons; Bradley Scott Haussler; Frank George Hamma; James Blake Winter; Jonathan L. Sullivan, all of Lincoln, Nebr.

[73] Assignee: Centurion International, Inc., Lincoln, Nebr.

[21] Appl. No.: 08/995,181

[22] Filed: Dec. 22, 1997

Related U.S. Application Data

[63] Continuation-in-part of application No. 08/962,001, Oct. 31, 1997, which is a continuation-in-part of application No. 08/918,447, Aug. 26, 1997.

[51] Int. Cl.[7] ..... H01Q 1/24

[52] U.S. Cl. ..... 343/702; 343/895; 343/900

[58] Field of Search ..... 343/702, 749, 343/722, 872, 895, 745; H01Q 1/24

[56] References Cited

U.S. PATENT DOCUMENTS

| | | | |
|---|---|---|---|
| 3,803,627 | 4/1974 | Schuscheng | 343/903 |
| 4,205,319 | 5/1980 | Gasparaitis et al. | 343/792 |
| 4,760,401 | 7/1988 | Imazeki | 343/702 |
| 4,772,895 | 9/1988 | Garay et al. | 343/895 |
| 4,849,767 | 7/1989 | Naitou | 343/745 |
| 4,857,939 | 8/1989 | Shimazaki | 343/715 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,218,370 | 6/1993 | Blaese | 343/702 |
| 5,218,372 | 6/1993 | Cheng | 343/749 |
| 5,245,350 | 9/1993 | Sroka | 343/702 |
| 5,300,940 | 4/1994 | Simmons | 343/749 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,446,469 | 8/1995 | Makino | 343/702 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |
| 5,594,457 | 1/1997 | Wingo | 343/702 |
| 5,646,635 | 7/1997 | Cockson et al. | 343/702 |
| 5,659,889 | 8/1997 | Cockson | 455/575 |
| 5,717,408 | 2/1998 | Sullivan et al. | 343/702 |
| 5,812,097 | 9/1998 | Maldonado | 343/790 |
| 5,963,170 | 10/1999 | Garner et al. | 343/702 |

FOREIGN PATENT DOCUMENTS

| | | |
|---|---|---|
| 0747990A1 | of 1996 | European Pat. Off. . |
| 6252621 | of 1994 | Japan . |
| 685519 | of 1994 | Japan . |

*Primary Examiner*—Hoanganh Le
*Assistant Examiner*—Shih-Chao Chen
*Attorney, Agent, or Firm*—Zarley,McKee,Thomte, Voorhees & Sease; Dennis L. Thomte

[57] ABSTRACT

A multi-band antenna comprising a device which is capable of functioning during at least a lower frequency band of operation and at least a higher frequency band of operation. The antenna comprises an elongated radiating element having a helical radiating element connected to one end thereof with one end of the helical radiating element being received by a non-conductive insulator. An outer conductive shell embraces the non-conductive insulator and at least partially encloses a portion of the helical radiating element. The straight radiating element acts as the antenna radiator during both the high and low frequency bands of operation.

4 Claims, 2 Drawing Sheets

MULTI-BAND ANTENNA

CROSS-REFERENCE TO RELATED APPLICATION

This is a continuation-in-part application of the patent application entitled MULTI-BAND RETRACTABLE ANTENNA Ser. No. 08/962,001 filed Oct. 31, 1997, which is a continuation-in-part application of the patent application entitled MULTI-BAND ANTENNA filed Aug. 26, 1997, under Ser. No. 08/918,447.

BACKGROUND OF THE INVENTION

1. Field of the Invention

This invention relates to a multi-band antenna and more particularly to a dual band antenna which automatically operates at two different frequency bands.

2. Description of the Related Art

Due to overcrowding of the cellular telephone infrastructure, the cellular telephone industry is looking for ways to create room for the ever-increasing number of cellular telephone subscribers. The creation of room for additional cellular telephone subscribers must be accomplished without degrading the quality of the audio signal or compromising the reliability or integrity of the wireless connection. Much research has been done in this area and several possible solutions have been suggested. One solution is to switch from the existing analog to digital systems, which has been proven to create better performance in terms of quality of signal and speed. In other words, digital technology provides the carrier with the ability to fit more cellular conversations in a given band width as compared to the analog system.

Another solution for the problem described above is to create more room in terms of frequency band width. The FCC has allocated more frequency bands to be used for cellular telephone conversations. This new band of spectrum is located around the 2 Ghz band and is used for telephone systems such as PCS band (Personal Communication System), DCS 1800, and DECT. This higher band was chosen primarily because of the availability of bands close to the original 800–900 MHz.

Unfortunately, the changes outlined above have created additional problems in the industry. The cellular telephone infrastructure in the United States and in other countries was originally built for the 800 to 900 MHz frequencies. Now, with the advent of digital systems and the use of the new higher frequencies, a dilemma arises in switching over to the new system. Many geographical areas will add the higher frequencies and the digital systems as a second system and will keep the original analog system operational. Some locations will stay with the old analog systems longer than others; therefore, to ensure full coverage, the user will either have to carry two telephones or purchase a "Multi-Mode" telephone. A "Multi-Mode" telephone is a telephone that will automatically switch from one system to the other depending upon the way it is programmed.

SUMMARY OF THE INVENTION

The multi-band antenna of this invention provides an antenna system that will effectively resonate at two or more separate frequency bands. The antenna of this invention will work consistently without having to switch or adjust the antenna or its impedance matching device. The multi-band antenna of this invention includes an elongated, straight radiating element having upper and lower ends, a helical radiating element connected to the lower end of the straight radiating element and which terminates in a lower end portion which is electrically connected to a non-conductive insulator. An outer conductive shell embraces the non-conductive insulator and at least partially encloses a portion of the helical radiating element in a spaced-apart relationship. A non-conductive housing embraces the outer conductive shell, helical radiating element and the straight radiating element. The outer conductive shell is electrically connected to the transceiver circuit of the communications device. The straight radiating element acts as the antenna radiator during the lower frequency band of operation. The electrical length of the antenna during the low frequency band of operation is between ⅛ and ¼ wave length. The straight radiating element also acts as the antenna radiator during the high frequency band of operation. The electrical length of the straight radiating element is approximately ⅜ wave length. In both the high and low bands of operation, the antenna requires impedance matching, which is accomplished by a capacitance and inductance that forms between the helical conductive element and the outer conductive shell. The value of the capacitance and inductance will change with the frequency and therefore enables the same matching technique to work for both bands of operation without adjusting or switching the value of matching components.

It is therefore a principal object of the invention to provide an improved multi-band antenna.

Still another object of the invention is to provide a multi-band antenna which does not require additional electronic switching circuitry within the communications device.

Still another object of the invention is to provide an antenna which exhibits no degradation of electrical performance (gain) when compared to a single band antenna system of equal electrical length.

Still another object of the invention is to provide an antenna which functions as a ¼ wave antenna at both frequencies, therefore not requiring matching circuitry under normal circumstances.

Still another object of the invention is to provide an antenna design that may be built internally or externally to the structure of the communications device.

Yet another object of the invention is to provide an antenna which falls within the packaging parameters of most wireless communication devices.

Yet another object of the invention is to provide an electrical and mechanical antenna design that can be easily tailored to any operational frequency band within the wireless communication frequency spectrum.

Still another object of the invention is to provide an antenna of the type described which is easily detachable from the communications device.

These and other objects will be apparent to those skilled in the art.

DESCRIPTION OF THE PREFERRED EMBODIMENT

Figure 1:
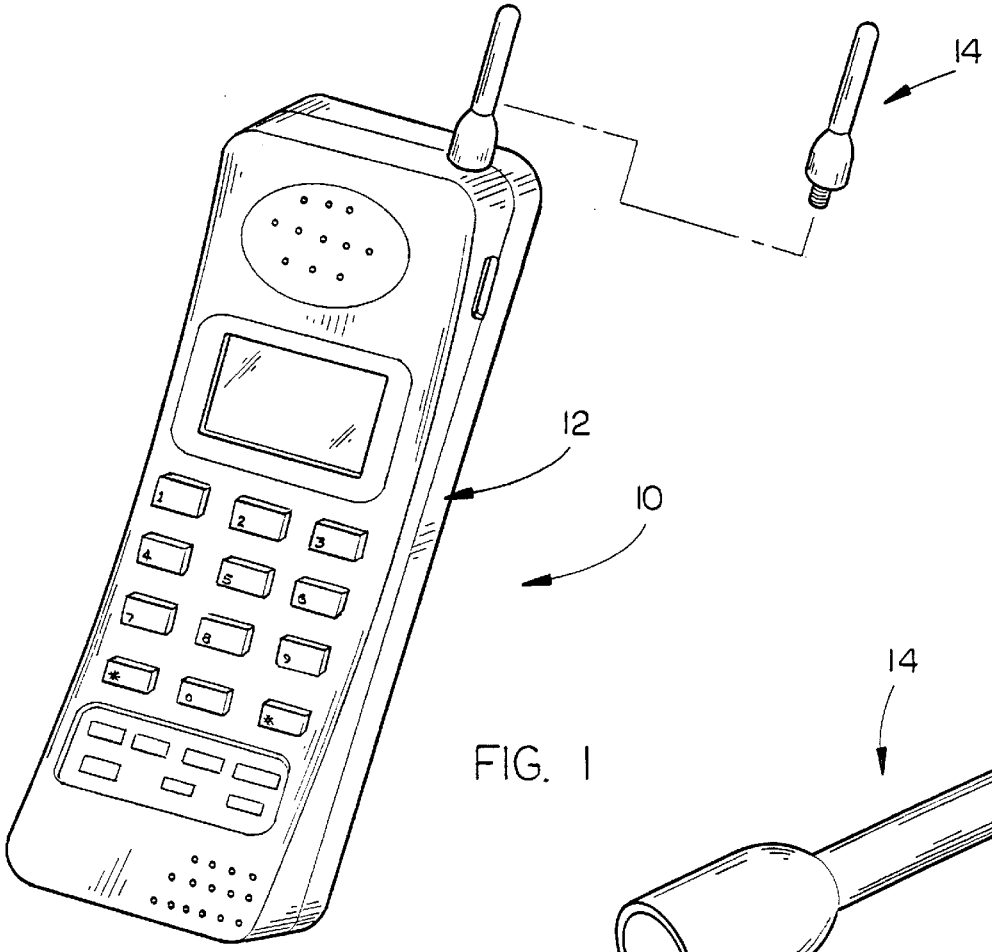
FIG. 1 is a perspective view of a cellular telephone having the multi-band antenna of this invention mounted thereon.
Figure 2:
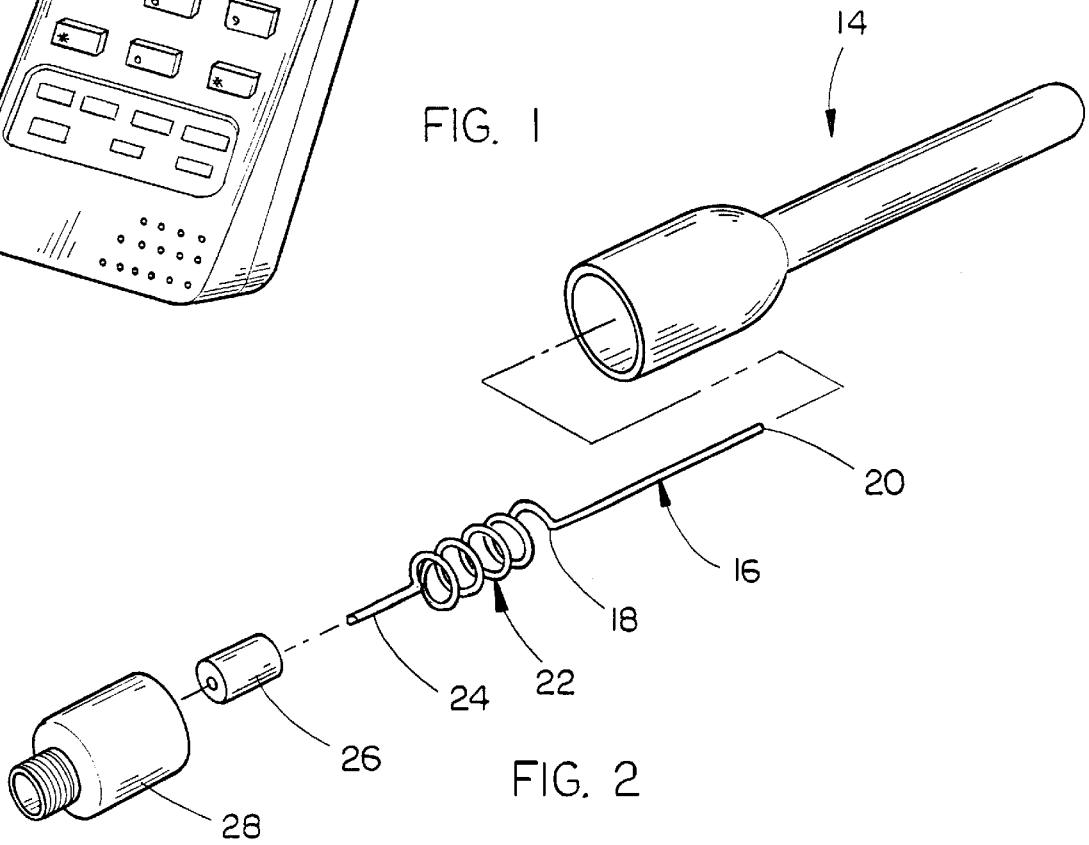
FIG. 2 is an exploded perspective view of the antenna of this invention.
Figure 4:
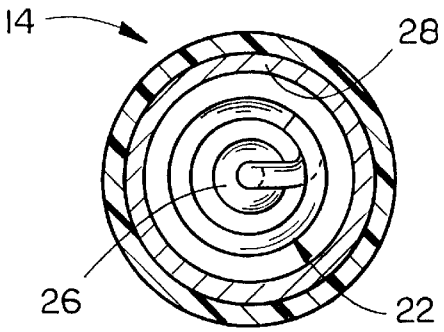
FIG. 4 is an enlarged sectional view seen on lines 4—4 of FIG. 3.

Referring to the drawings, the numeral 10 refers to a conventional cellular telephone including a housing 12. The telephone 10 includes conventional circuitry therein. The numeral 14 refers to the multi-band antenna of this invention and which is shown in the drawings to be mounted at the upper end of the housing 12. However, the antenna of this invention may be mounted interiorally of the housing 12, if so desired.

Antenna 14 includes an elongated, straight radiating element 16 having opposite ends 18 and 20. Antenna 14 also includes a helical radiating element 22 having its upper end connected to the lower end 18 of the radiating element 16. As seen in the drawings, helical radiating element 22 is provided with a lower end portion 24 which is received by a non-conductive insulator 26.

Figure 3:
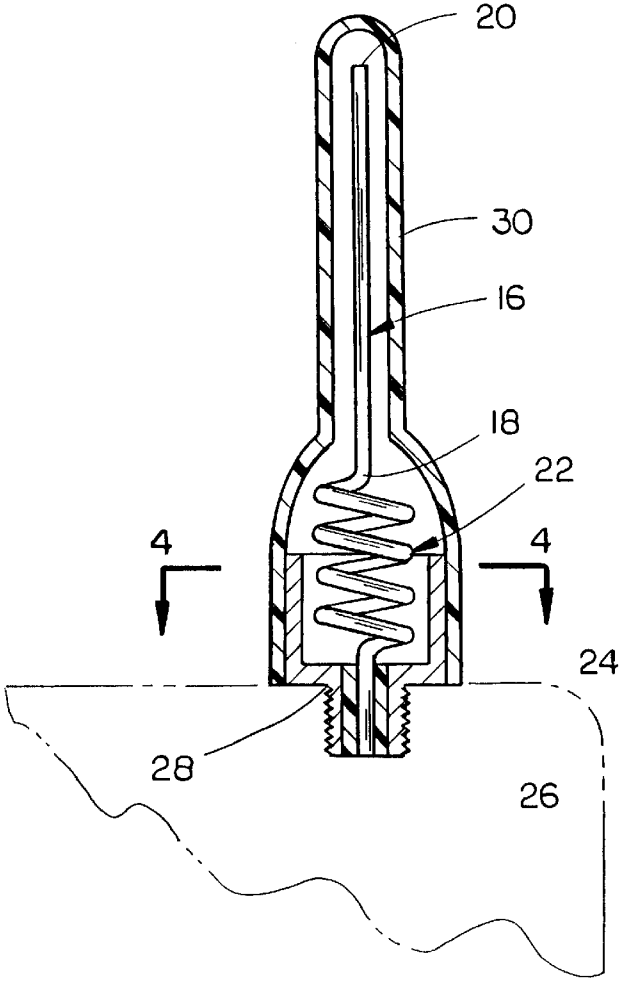
FIG. 3 is a longitudinal sectional view of the antenna of this invention.

Another conductive shell 28 embraces the non-conductive insulator 26 and at least partially encloses the helical radiating element 22 in a spaced-apart relationship, as illustrated in FIG. 3. The numeral 30 refers to a non-conductive housing which encloses the components of the antenna. The outer conductive shell 28 may have a conductive connector mounted thereon to enable the antenna to be connected to the transceiver circuit of the telephone or the shell 28 may be threaded, as seen in FIG. 3, so as to be threadably received in the conventional phone structure.

In operation, the straight radiating element 16 acts as the antenna radiator during the low frequency band of operation. The electrical length of the antenna during the low band of operation is between ⅛ and ¼ wave length. This is determined by the length of the conductive element 16, i.e., [$\lambda$=300/f(Mc.)]. The antenna output impedance is higher than the required 50 ohms and therefore must be matched electrically. The gain is slightly lower than a ¼ wave antenna in the low band mode of operation due the shortened length of the effective aperture.

The straight radiating element 16 also acts as the antenna radiator during the high frequency band of operation. The electrical length of the straight radiating element 16 is ⅜ wave length and exhibits high impedance.

In both the high and low bands of operation, the antenna requires impedance matching. This matching is accomplished internal to the antenna by a capacitance and inductance that forms between the helical radiating element 22 and the outer conductive shell 28. The value of capacitance and inductance depends upon many design variables. These variables include, but are not limited to, the outside diameter of the helical radiating element 22, the distance between the coils of the helical radiating element 22, the inside diameter of the outer conductive shell 28, and the electrical characteristics of the non-conductive insulation material 26. The value of this capacitance and inductance will change with frequency and therefore enables the same matching technique to work for both bands of operation without adjusting or switching the value of matching components. The design of the communications device or telephone 10 and particularly the connector design are variables that must be considered during the design process.

Thus it can be seen that the invention accomplishes at least all of its stated objectives.

We claim:

1. In combination with a communications device including a housing and a transceiver circuit disposed within the housing, comprising:

a non-retractable multi-band antenna capable of functioning during at least a lower frequency band of operation and at least a higher frequency band of operation;

said antenna comprising an elongated, straight radiating element having opposite ends; a helical radiating element having opposite ends; one end of said helical radiating element connected to one -end of said straight radiating element; a non-conductive insulator mounted on the other end of said helical radiating element; an outer conductive shell embracing said non-conductive insulator and at least partially enclosing a portion of said helical radiating element in a spaced-apart relationship; said outer conductive shell being RF connected to the transceiver circuit whereby said straight radiating element acts as the antenna radiator during the said lower frequency band of operation and also acts as the antenna radiator during the said higher frequency band of operation.

2. The combination of claim 1 wherein the relationship of said helical radiating element and said outer conductive shell is such that capacitance and induction is created between said helical radiating element and said outer conductive shell in both said lower and higher frequency bands of operation to provide impedance matching for said antenna.

3. The combination of claim 2, wherein the electrical length of said antenna is ¼ wave length during said lower and higher frequency bands of operation.

4. The combination of claim 1 wherein a non-conductive housing encloses said straight radiating element, said helical radiating element, and a portion of said outer conductive shell.

* * * * *